US008447056B2

(12) United States Patent
Akino et al.

(10) Patent No.: US 8,447,056 B2
(45) Date of Patent: May 21, 2013

(54) DYNAMIC MICROPHONE

(75) Inventors: Hiroshi Akino, Tokyo (JP); Hiroaki Furuya, Tokyo (JP); Haruhito Shimura, Tokyo (JP); Satoshi Yoshino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 15 days.

(21) Appl. No.: 13/307,205

(22) Filed: Nov. 30, 2011

(65) Prior Publication Data

US 2012/0140972 A1 Jun. 7, 2012

(30) Foreign Application Priority Data

Dec. 2, 2010 (JP) ..... 2010-269015

(51) Int. Cl.
*H04R 25/00* (2006.01)

(52) U.S. Cl.
USPC ..... 381/356; 381/355; 381/368

(58) Field of Classification Search
USPC ..... 381/355–360, 361–362, 366, 368
See application file for complete search history.

(56) References Cited

U.S. PATENT DOCUMENTS

| | | | | |
|---|---|---|---|---|
| 5,742,697 | A * | 4/1998 | Ching-Chung | 381/355 |
| 6,091,828 | A * | 7/2000 | Akino et al. | 381/355 |
| 6,128,393 | A * | 10/2000 | Kondo | 381/368 |

FOREIGN PATENT DOCUMENTS

| | | |
|---|---|---|
| JP | 10-145882 | 5/1998 |
| JP | 11-196489 | 7/1999 |
| JP | 11-331987 | 11/1999 |

* cited by examiner

*Primary Examiner* — Suhan Ni

(74) *Attorney, Agent, or Firm* — Whitham Curtis Christofferson & Cook, PC

(57) ABSTRACT

A dynamic microphone includes a vibration pickup that detects vibration of a dynamic microphone unit, and outputs a signal for cancelling vibration noise; and a microphone case that supports the microphone unit and the vibration pickup, wherein the vibration pickup includes a laminated ceramic piezoelectric element that detects vibration of a microphone unit case and outputs a signal corresponding to the detected vibration, the laminated ceramic piezoelectric element has a capacitance that defines a resonance circuit in conjunction with an inductance of an inductor, the resonance circuit producing a response signal to acceleration corresponding to that of the vibration noise, and the resonance circuit is connected such that the response signal is output in an opposite direction to the vibration noise signal.

10 Claims, 10 Drawing Sheets

DYNAMIC MICROPHONE

BACKGROUND OF THE INVENTION

1. Field of the Invention

The present invention relates to a dynamic microphone having a structure and a circuit for reducing vibration noise, the circuit including a piezoelectric element having a certain capacitance as a vibration sensor for cancelling undesired vibration.

2. Related Background Art

A dynamic microphone includes a diaphragm and a voice coil fixed to the diaphragm, where the voice coil is disposed in a magnetic gap in a magnetic circuit including a magnet, a yoke, and a pole piece. The diaphragm vibrates upon receiving sound waves, and the voice coil also vibrates to traverse a magnetic flux in the magnetic gap. As a result, sound signals corresponding to the sound waves are output from the voice coil.

A hand-held dynamic microphone tends to generate unpleasant noise due to vibration caused by rubbing a microphone case with a hand, gripping or placing the microphone, or any other handling. The vibration noise is resulted from relative movement of a movable portion including the diaphragm and the voice coil to a fixed portion including the microphone case and components of the magnetic circuit, the movement being induced by vibration caused by factors other than the sound waves. Nondirectional dynamic microphones have been widely used for hand-held dynamic microphones because of its relatively low susceptibility to such vibration noise.

In the meantime, unidirectional dynamic microphones have requests about their use as hand-held dynamic microphones. Directional analysis of a unidirectional dynamic microphone indicates that its directional characteristics include a nondirectional component and a bidirectional component. The bidirectional component of the unidirectional dynamic microphone is to be mass-controlled, and thus the resonant frequency of the diaphragm is set to 100 to 200 Hz, close to the lower limit of a sound pickup range. FIG. 10 shows a vibration equivalent circuit of a typical unidirectional dynamic microphone. In FIG. 10, symbol m0 denotes mass of a diaphragm, symbol s0 denotes stiffness of the diaphragm, symbol r1 denotes acoustic resistance for obtaining the nondirectional component, and symbol m1 denotes acoustic mass for obtaining the bidirectional component. These circuit constants are set to appropriate values to fix the resonant frequency to a target value.

In the unidirectional dynamic microphone, the resonant frequency of the diaphragm is set to a value close to the lower limit of the sound pickup range as described above, and thus handling of the microphone can readily generate vibration noise called handling noise. A light material such as a copper clad aluminum wire (CCAW) is used for the voice coil to reduce mass of the movable portion, leading to a reduction in vibration noise. This, however, raises the resonant frequency of the diaphragm; hence, the stiffness of the diaphragm must be decreased (compliance must be increased) to lower the low frequency limit to a desired value. While some microphones have shock mounts to support a microphone unit therethrough as a measure against the vibration noise, the low-frequency vibration noise cannot be readily reduced only by the shock mounts.

In this way, the vibration noise cannot be readily reduced by material design or by the shock mounts within a basic frame of the microphone, and thus an additional structure or mechanism is necessary to actively reduce or cancel the vibration noise. Conventional microphones having such a structure or mechanism are described below.

Japanese Unexamined Patent Application Publication No. 11-331987 (JP-A-11-331987) discloses a microphone including a microphone unit, a microphone case that supports the microphone unit therein through shock mounts, a shock sensor that detects vibration applied to the microphone case, and a signal processor that attenuates signals generated through electroacoustic conversion in the microphone unit and outputs the attenuated signals.

Japanese Unexamined Patent Application Publication No. 10-145882 (JP-A-10-145882) discloses a microphone including two vibration transmission paths, that is, a diaphragm-side path and a magnetic-circuit-side path, where a difference in relative velocity between a diaphragm and a magnetic circuit is reduced to cancel the vibration noise. Specifically, first and second elastic members are disposed on the top and the bottom of the periphery of the diaphragm 13, respectively, and the diaphragm 13 is attached to a unit case through the first elastic member at the top of the periphery, and a magnetic circuit section is accommodated in a unit case while one end of the circuit section is in contact with the second elastic member at the bottom of the periphery. Vibrations applied to the unit case are primarily transmitted to the second elastic body through the first elastic member and then to the magnetic circuit section. Such a limitation of the solid propagation path for the vibration waves can reduce the vibration noise over a wide range caused by rubbing of the unit case.

Japanese Unexamined Patent Application Publication No. 11-196489 (JP-A-11-196489) discloses a dynamic microphone including a dynamic vibration pickup for detecting vibration noise, where vibration noise generated in a microphone unit is cancelled using detected signals. Specifically, a vibration detection unit being an acoustic element is disposed in an air chamber communicating with the microphone unit, and variation of internal pressure in the air chamber, which is caused by vibration of a diaphragm of the vibration detection unit, propagates to the back of another diaphragm of the microphone unit so as to prevent the second diaphragm from being displaced by external vibration, leading to active cancellation of the vibration noise.

In the microphone disclosed in JP-A-11-331987, the output signal level of the microphone is attenuated in response to external vibration so as to attenuate the output noise level. A disadvantage of the microphone is a reduction in output signal level in response to the external vibration.

In the microphone disclosed in JP-A-10-145882, the diaphragm and the magnetic circuit move parallel in response to external vibration to reduce a difference in relative speed therebetween. Thus, in order to reduce the vibration noise on target, mechanical impedances, including mass of movable portions such as the diaphragm, mass of the magnetic circuit, and an elastic coefficient of each elastic member, must be designed and adjusted to appropriate values. Such design and adjustment requires much time and effort. In addition, these coefficients or values may vary due to variations in environmental conditions such as temperature, precluding a reduction in the vibration noise on target.

In the dynamic microphone disclosed in JP-A-11-196489, the dynamic vibration pickup must be designed and manufactured such that the vibration pickup produces output in accordance with the vibration noise in the microphone unit, which requires much time and effort for design and adjustment. Moreover, mechanical impedances must be designed and adjusted to appropriate values as in JP-A-10-145882, which also requires much time and effort for design and adjustment. Furthermore, the mechanical impedances may vary due to variation in environmental conditions such as temperature, making it difficult to reduce the vibration noise on target.

SUMMARY OF THE INVENTION

Active cancellation of the vibration noise in the dynamic microphone requires matching of the resonant frequency, resonance sharpness, and signal level between the vibration noise and a signal for cancelling the vibration noise. Electrical and continuous adjustment of these three factors will facilitate designing and production of the microphone.

It is an object of the present invention to provide a dynamic microphone that can electrically and continuously adjust the resonant frequency, resonance sharpness, and signal level of a cancellation signal in correspondence to vibration noise to effectively reduce the vibration noise, achieving effective cancellation of the vibration noise using the cancellation signal.

A dynamic microphone according to the invention includes a dynamic microphone unit; a vibration pickup that detects vibration of the dynamic microphone unit, and outputs a signal for cancelling vibration noise output from the dynamic microphone unit; and a microphone case that supports the dynamic microphone unit and the vibration pickup, wherein the vibration pickup includes a laminated ceramic piezoelectric element that is supported in an integrated manner with a microphone unit case, and detects vibration of the microphone unit case and outputs a signal corresponding to the detected vibration, the laminated ceramic piezoelectric element has a capacitance that defines a resonance circuit in conjunction with an inductance of an inductor connected to the laminated ceramic piezoelectric element, the resonance circuit producing a response signal to acceleration corresponding to that of the vibration noise from the microphone unit, and the resonance circuit is connected to the microphone unit such that the response signal is output in an opposite direction to the vibration noise signal output from the microphone unit.

Vibration of the microphone case is transmitted to the microphone unit case, causing vibration of magnetic circuit components substantially integrated with the microphone unit case. In response to the vibration of the magnetic circuit components, a movable portion including a diaphragm and a voice coil relatively moves due to an inertial force, generating vibration noise. The vibration of the microphone unit case is also transmitted to the vibration pickup, and the vibration pickup vibrates and outputs a signal corresponding to the received vibration. The vibration pickup is connected to the microphone unit such that the output signal is output in an opposite direction to the vibration noise signal output from the microphone unit, and thus operates to cancel the vibration noise signal. In addition, the vibration pickup includes a laminated ceramic piezoelectric element having a large capacitance that can define a resonance circuit in conjunction with an inductance of the inductor, the resonance circuit resonating at a low frequency band such as a frequency band of the vibration noise, achieving effective cancellation of the vibration noise.

DESCRIPTION OF THE PREFERRED EMBODIMENT

An embodiment of a dynamic microphone according to the present invention is described below with reference to the attached drawings.

Figure 1:
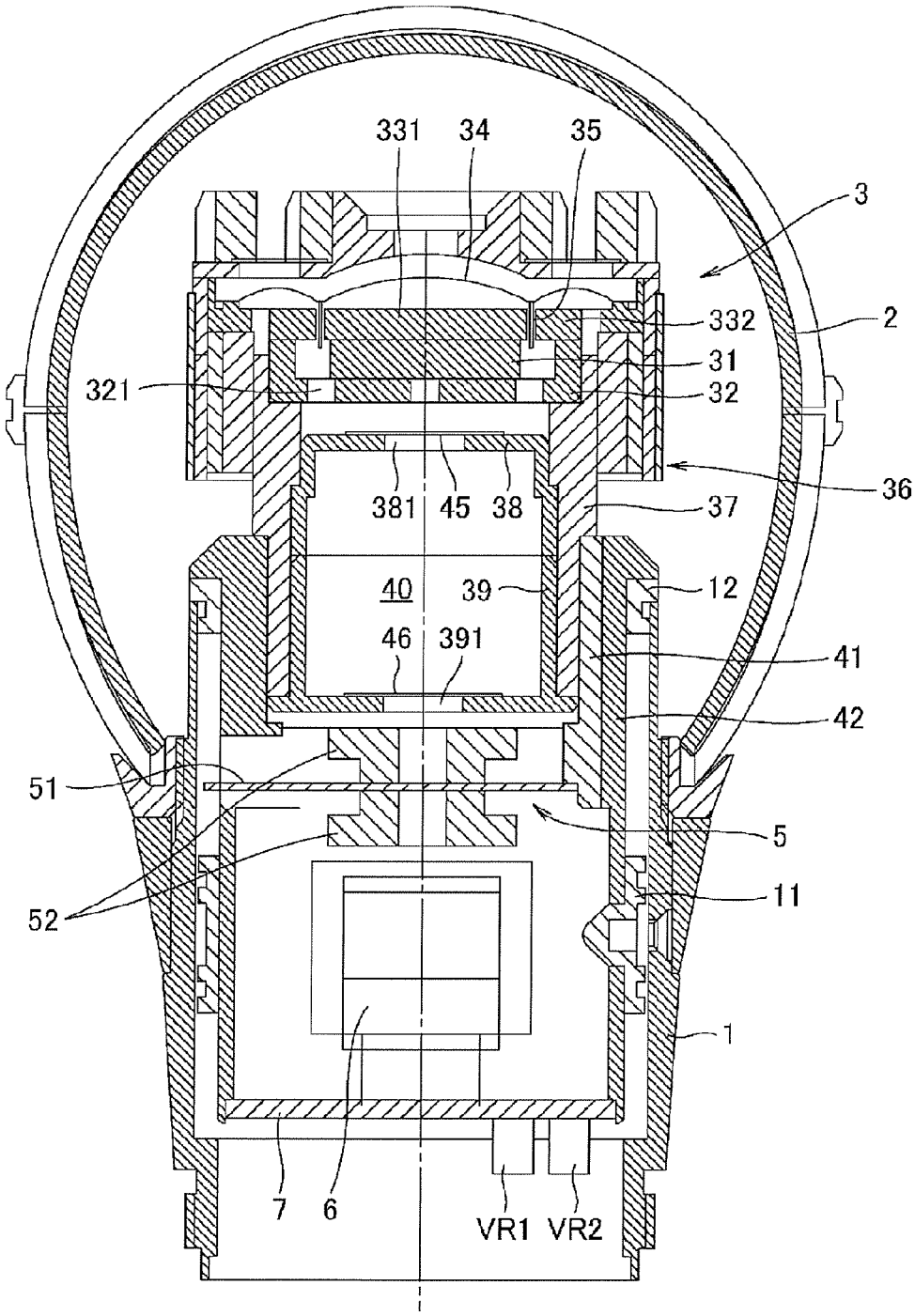
FIG. 1 is a longitudinal section view showing major parts of a dynamic microphone according to an embodiment of the invention.
Figure 2:
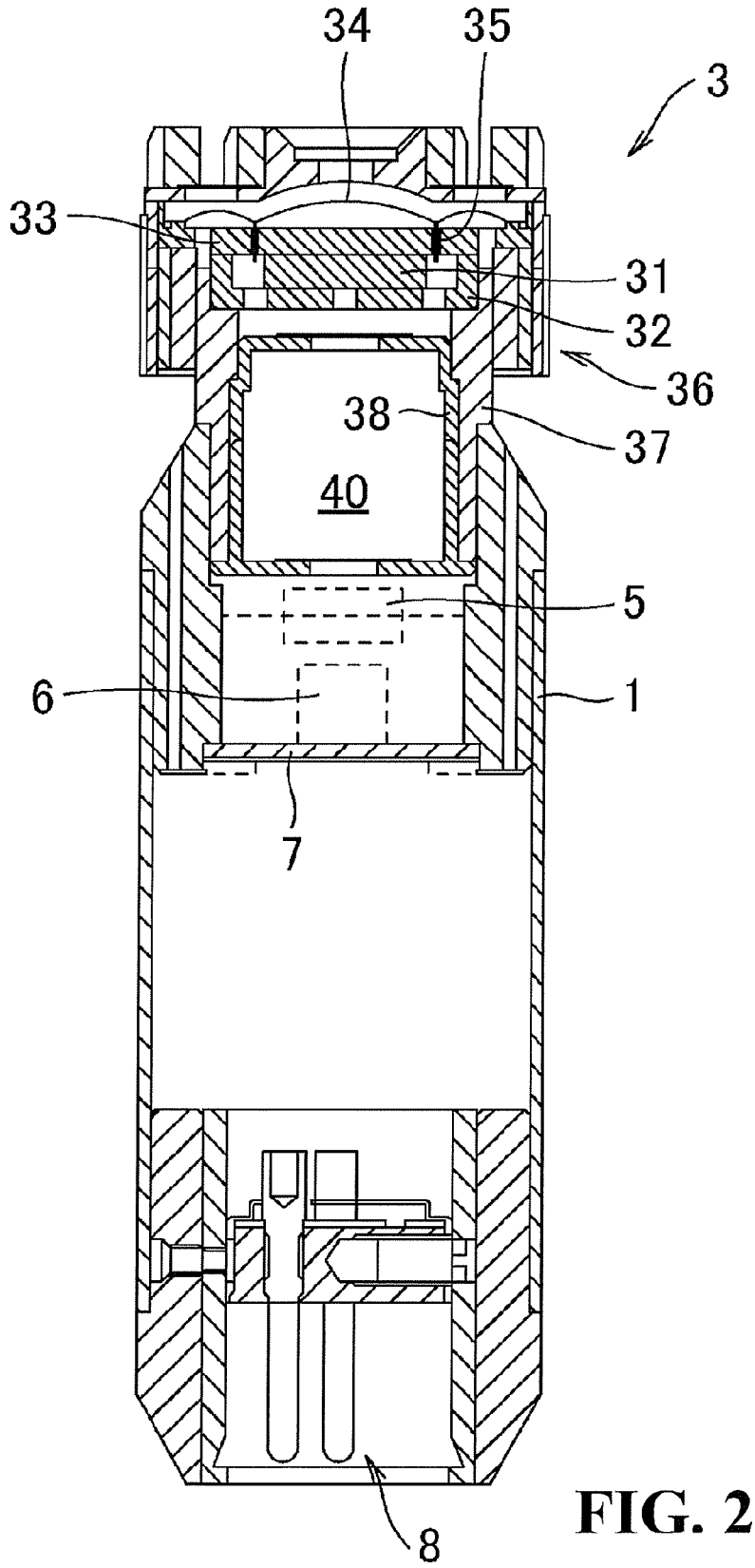
FIG. 2 is a longitudinal section view showing a portion including a microphone unit, a vibration pickup, and a connector of the dynamic microphone of the embodiment.

With reference to FIGS. 1 and 2, a cylindrical microphone case 1 has an end (the upper end in the drawings) to which a dynamic microphone unit 3 and a vibration pickup 5 are fixed. The dynamic microphone unit 3 has a magnetic circuit including a flat-bottomed yoke 32, a circular magnet 31 fixed to the center on the inside bottom of the yoke 32, a pole piece 331 fixed to the top of the magnet 31, and an annular yoke 332 fixed to the upper end face of the yoke 32 around the pole piece 331.

The magnetic circuit has a cylindrical magnetic gap between the outer circumferential surface of the pole piece 331 and the inner circumferential surface of the yoke 332. A voice coil 35 is disposed in the magnetic gap while being fixed to a diaphragm 34. The diaphragm 34 includes a central dome having a partial spherical shape, and a sub-dome having an arcuate section around the central dome. The outer circumferential edge of the sub-dome is fixed to a member substantially integrated with a unit case 36. The voice coil 35 is fixed along the ridgeline at the boundary between the central dome and the sub-dome. Upon receiving sound waves, the diaphragm 34 vibrates with the voice coil 35 in an anteroposterior direction of the sound waves (the vertical direction in FIG. 1 or 2), and the voice coil 35 traverses a magnetic flux in the magnetic gap to generate an electric current flowing through the voice coil. As a result, sound signals corresponding to the sound waves are output from the voice coil.

The microphone unit 3 is supported by the microphone case 1 having the following structure. The outer circumferential end of a bottom of the yoke 32, which is one of the magnetic circuit components of the microphone unit 3, is fitted in the inner circumferential surface of the upper end of a supporting cylinder 37, and supported by a step formed on the inner circumferential surface of the upper end. The supporting cylinder 37 extends downward, and an intermediate cylinder 41 is fitted over an outer circumferential surface of substantially lower half of the supporting cylinder 37. An outer cylinder 42 is fitted over the outer circumferential surface of the intermediate cylinder 41. Consequently, the supporting cylinder 37, the intermediate cylinder 41, and the outer cylinder 42 are coupled into one unit. The microphone case 1 is disposed around the outer cylinder 42 with a predetermined gap, and shock mounts 11 and 12 are interposed between the outer cylinder 42 and the microphone case 1. The outer cylinder 42 extends further downward than the intermediate cylinder 41. The first shock mount 11 is interposed between such an extension of the outer cylinder 42 and the microphone case 1, and the second shock mount 12 is interposed between the upper end of the outer cylinder 42 and the upper end of the microphone case 1. As a result, the microphone unit 3 is supported by the shock mounts 11 and 12 in the microphone case 1.

Blind cylinders 38 and 39 are fitted in the inner circumferential surface of the supporting cylinder 37 such that open ends of the blind cylinders abut each other (bottoms thereof are separated), thereby to form a space 40 enclosed by the blind cylinders 38 and 39. The blind cylinder 38 is disposed on the upper side while the blind cylinder 39 is disposed on the lower side. Openings 381 and 391 are provided in the bottoms of the blind cylinders 38 and 39 and covered by acoustic resistances 45 and 46, respectively.

Figure 5:
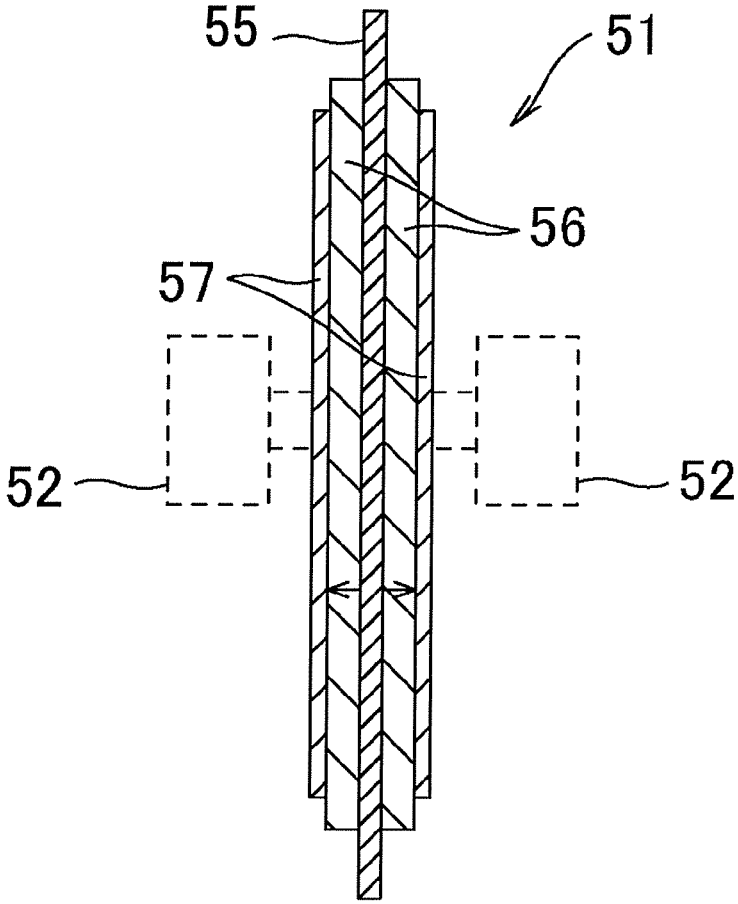
FIG. 5 is a longitudinal section view showing an exemplary laminated ceramic piezoelectric element as a vibration pickup used for the invention.

The vibration pickup 5 is disposed below the blind cylinder 39 while being supported by the intermediate cylinder 41 substantially integrated with the microphone unit case 36. The vibration pickup 5 includes a laminated ceramic piezoelectric element 51 that detects vibration of the microphone unit case 36 and outputs a signal corresponding to the vibration. With reference to FIG. 5, the laminated ceramic piezoelectric element 51 includes an electrode substrate 55 composed of, for example, stainless steel, ceramic piezoelectric element bodies 56 fixed to two sides of the electrode substrate 55, and electrodes 57 formed of, for example, silver deposited on surfaces of the ceramic piezoelectric bodies 56. The ceramic piezoelectric bodies 56 are distorted to generate electricity in response to pressure applied to the ceramic piezoelectric element 51 and output signals through the electrode substrate 55 and the electrodes 57. A laminated small speaker can include a ceramic piezoelectric element, for example, as the laminated ceramic piezoelectric element 51. The laminated small speaker has a large capacitance that is advantageous for configuration of a resonance circuit that can produce a response signal to certain acceleration similar to that of the vibration noise from the microphone unit 3, as described below.

The laminated ceramic piezoelectric element 51, which is a major component of the vibration pickup 5, is supported by the intermediate cylinder 41 at the periphery of the ceramic piezoelectric element 51, or the periphery of the electrode substrate 55 in the exemplary laminated ceramic piezoelectric element 51 shown in FIG. 5, in a substantially integrated manner with the microphone unit case 36. While the laminated ceramic piezoelectric element 51 may be supported over the entire periphery in a substantially integrated manner with the microphone unit case 36, the ceramic piezoelectric element 51 is supported in a cantilever manner while the periphery thereof is partially fixed to the intermediate cylinder 41 in the embodiment shown in the drawings. In addition, weights 52 are fixed to both sides of the ceramic piezoelectric element 51 to enhance deflection of the ceramic piezoelectric element 51 induced by vibration transmitted to the ceramic piezoelectric element 51 so that large vibration-detected signals are output.

A circuit substrate 7 is fitted in the inner circumferential surface of the lower end of the outer cylinder 42. An inductor 6 is mounted on the top of the circuit substrate 7 in a space between the substrate 7 and the vibration pickup 5. Two variable resistances VR1 and VR2 are mounted on the bottom of the circuit substrate 7. The resistance values of the variable resistances VR1 and VR2 can be adjusted for adjustment of resonance sharpness and the signal level of a resonance circuit including the laminated ceramic piezoelectric element 51 and the inductor 6. A variable capacitor (not shown) is mounted on the circuit substrate 7 so that the resonant frequency of the resonance circuit can be adjusted by varying the capacitance of the variable capacitor. While the inductor 6 is of a fixed type in the embodiment, the inductor 6 may be of a variable type that is varied to adjust the resonant frequency of the resonance circuit. The resonance circuit and an equivalent circuit thereof are described later.

The microphone unit 3 is a unidirectional dynamic microphone unit. A space on the back of the diaphragm 34 communicates with a space between the yoke 32 and the blind cylinder 38 through an appropriate number of holes 321 provided in the yoke 32, and with a space 40 through the acoustic resistance 45 and the opening 381, and with a space enclosed by the intermediate cylinder 41 around the blind cylinder 39 through the acoustic resistance 46 and the opening 391. The acoustic resistance of the space on the back of the diaphragm 34 is set to an appropriate value, achieving unidirectional characteristics of the dynamic microphone unit 3.

As shown in FIG. 2, a microphone connector 8 is attached to the rear end (the lower end in FIG. 2) of the microphone case 1. The microphone connector 8 is typically a standardized 3-pin connector having a ground pin, a HOT signal pin, and a COLD signal pin.

Figure 3:
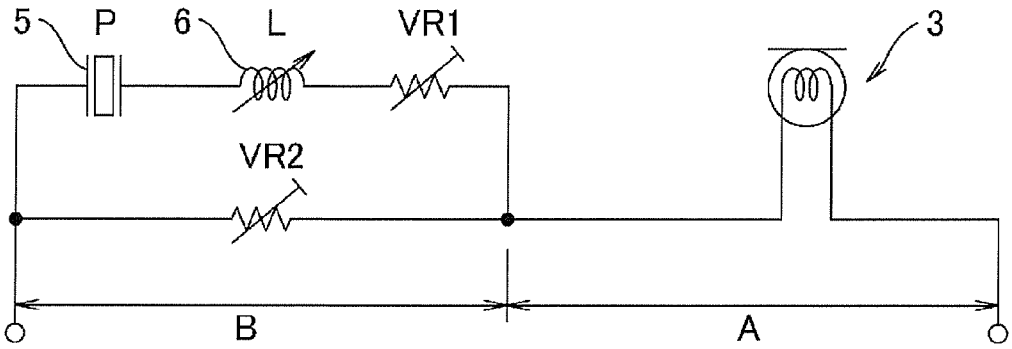
FIG. 3 is a circuit diagram showing an exemplary electrical connection in the dynamic microphone of the embodiment.

FIG. 3 shows a circuit configuration of the microphone of the embodiment. In FIG. 3, symbol A represents the region of the microphone unit 3, and symbol B represents the region of the resonance circuit to produce a response signal to certain acceleration similar to that of the vibration noise from the microphone unit 3. The vibration pickup 5 generating an electromotive force P, the inductor 6 having an inductance L, the variable resistance VR1 and the microphone unit 3 are connected in series, and end terminals of these components connected in series correspond to output terminals of the microphone unit 3. The resonance circuit corresponds to a region including the vibration pickup 5, the inductor 6, and the variable resistance VR1; and the variable resistance VR2 is connected parallel to the resonance circuit.

Figure 4:
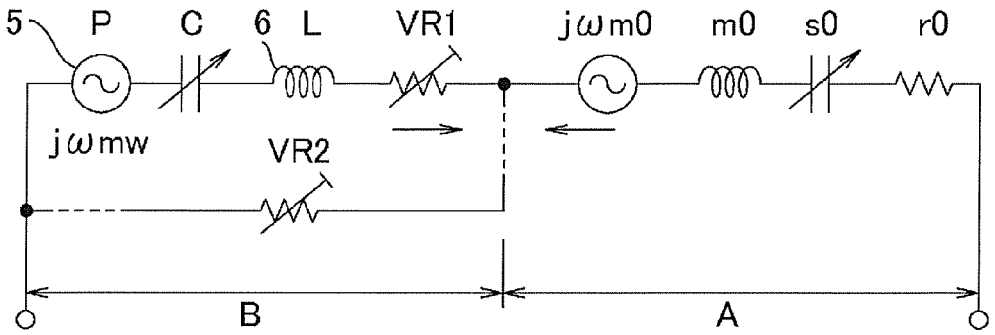
FIG. 4 is an acoustic equivalent circuit diagram of the dynamic microphone of the embodiment.

FIG. 4 shows an acoustic equivalent circuit of the above-described circuit configuration of the microphone of the embodiment. In FIG. 4, symbol $j\omega m0$ represents the vibration noise output from the microphone unit 3 due to external vibration. The region A of a series circuit includes the mass m0 of the diaphragm of the microphone unit 3, the stiffness s0 of the diaphragm, the acoustic resistance r0, and the vibration noise $j\omega m0$ corresponds to the region of the microphone unit 3. The region of the resonance circuit B includes a series circuit of the vibration pickup 5, inductor 6, and variable resistance VR1 as described above and further includes a variable capacitor C added in series to the series circuit. The variable resistance VR2 is connected parallel to the resonance circuit. The vibration pickup 5 outputs a signal $j\omega mw$ in response to external vibration, where symbol mw represents mass of the vibration pickup 5 including the weights 52.

As shown by arrows in FIG. 4, the circuit components are connected such that vibration noise output from the microphone unit 3 has a polarity opposite to that of the vibration-detected signals output from the vibration pickup 5 of the resonance circuit, so that the vibration noise is cancelled by the vibration-detected signals As described above, the laminated ceramic piezoelectric element, which is the major component of the vibration pickup 5, has a relatively large capacitance. As shown in FIG.

5, the piezoelectric element bodies 56 on two sides of the electrode substrate 55 have capacitances of about 0.5 μF together with the electrode substrate 55 and the electrodes 57, leading to a total capacitance of about 1.0 μF. The resonance circuit is composed of the capacitance of the laminated ceramic piezoelectric element 51, the capacitance of the capacitor C connected in series to the ceramic piezoelectric element 51, and the inductance L of the inductor 6. The resonant frequency of the resonance circuit is determined by the above-described capacitances and the inductance L. The laminated ceramic piezoelectric element 51 has a large capacitance, for example, of about 1.0 μF as described above, and thus the resonant frequency of the resonance circuit can be readily adjusted to a low frequency band such as a frequency band of the vibration noise output from the microphone unit 3.

The vibration pickup 5 includes the laminated ceramic speaker including the laminated ceramic piezoelectric element that is to be elasticity-controlled, achieving a uniform response to acceleration of the resonant frequency or lower and a high output level. Accordingly, the configuration described in the embodiment provides response characteristics corresponding to the acceleration similar to that of the vibration noise in the dynamic microphone.

In the embodiment, the resonant frequency of the resonance circuit can be adjusted by varying the capacitance of the variable capacitor C shown in FIG. 4. The variable capacitor C preferably includes, for example, a capacitor having a continuously variable capacitance by varying the overlapping ratio of a rotatable electrode to a fixed electrode.

Figure 6:
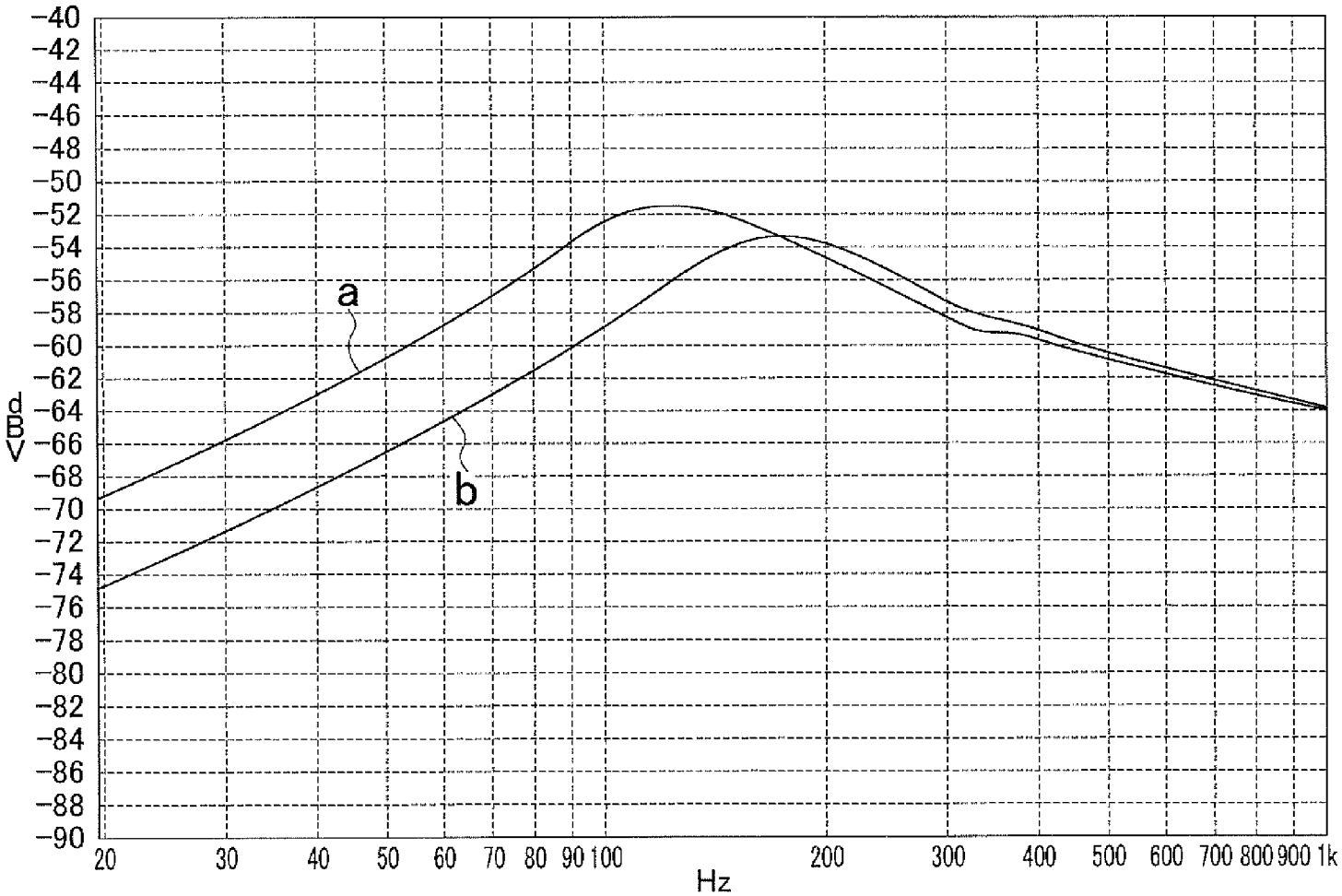
FIG. 6 is a graph showing adjustment of resonant frequency in the embodiment.

FIG. 6 is a graph showing a variation in the resonant frequency of the resonance circuit with a variation in the capacitance of the variable capacitor C, the abscissa indicating frequencies (Hz) and ordinate indicating output level (dBV). The curve "a" represents the variation for the variable capacitor C having a large capacitance, and the curve "b" represents the variation for the variable capacitor C having a small capacitance. The capacitance of the variable capacitor C is varied to adjust the resonant frequency of the resonance circuit to the frequency band of the vibration noise output from the microphone unit 3, achieving effective cancellation of the vibration noise. In the case of a variable inductor 6, the resonant frequency can be adjusted by varying the inductance of the inductor 6 without addition of the variable capacitor C.

Figure 7:
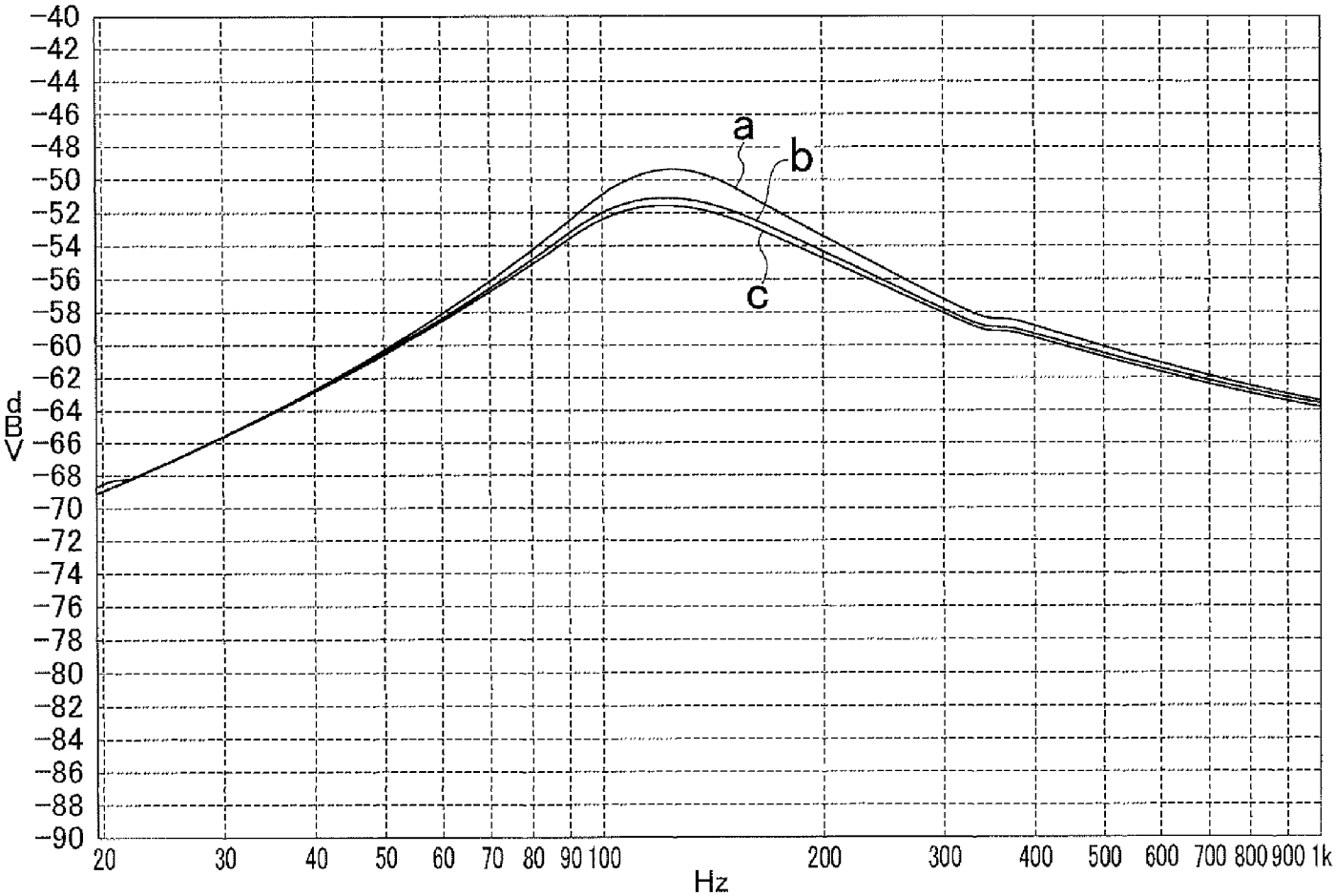
FIG. 7 is a graph showing adjustment of resonance sharpness in the embodiment.

The resonance sharpness or sharpness of a peak around the resonant frequency of the resonance circuit can be varied by changing the resistance value of the variable resistance VR1 shown in FIG. 4. FIG. 7 is a graph showing a variation in the resonance sharpness of the resonance circuit with a variation in the resistance value of the variable resistance VR1, the abscissa indicating frequencies (Hz) and the ordinate indicating output level (dBV). The resonance sharpness is reduced in order of the curves a, b and c with an increase in the resistance value of the variable resistance VR1. The resonance sharpness is adjusted in correspondence to sharpness around a peak of the vibration noise output from the microphone unit 3 or to the frequency band of the vibration noise, achieving effective cancellation of the vibration noise.

Figure 8:
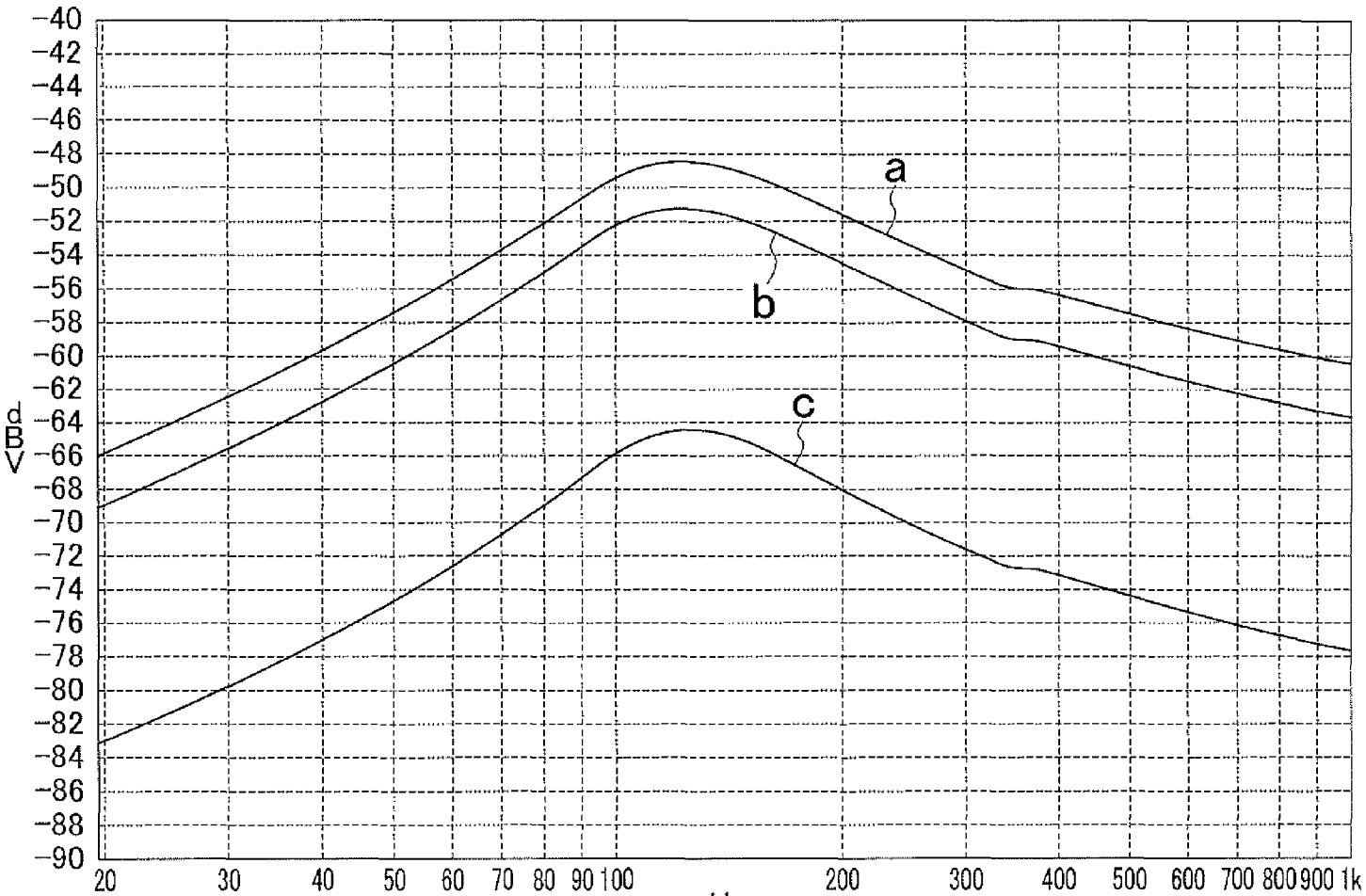
FIG. 8 is a graph showing adjustment of an output level of a resonance signal in the embodiment.

The output level of the resonance circuit can be varied by changing the resistance value of the variable resistance VR2 shown in FIG. 4. FIG. 8 is a graph showing a variation in the output level of the resonance circuit with variation of the resistance value of the variable resistance VR2, the abscissa indicating frequencies (Hz) and the ordinate indicating output level (dBV). The output level decreases parallel in order of the curves a, b and c with an decrease in the resistance value of the variable resistance VR2. The VR2 is adjusted to obtain an output level of the resonance circuit corresponding to a level of the vibration noise output from the microphone unit 3, achieving effective cancellation of the vibration noise.

Figure 9:
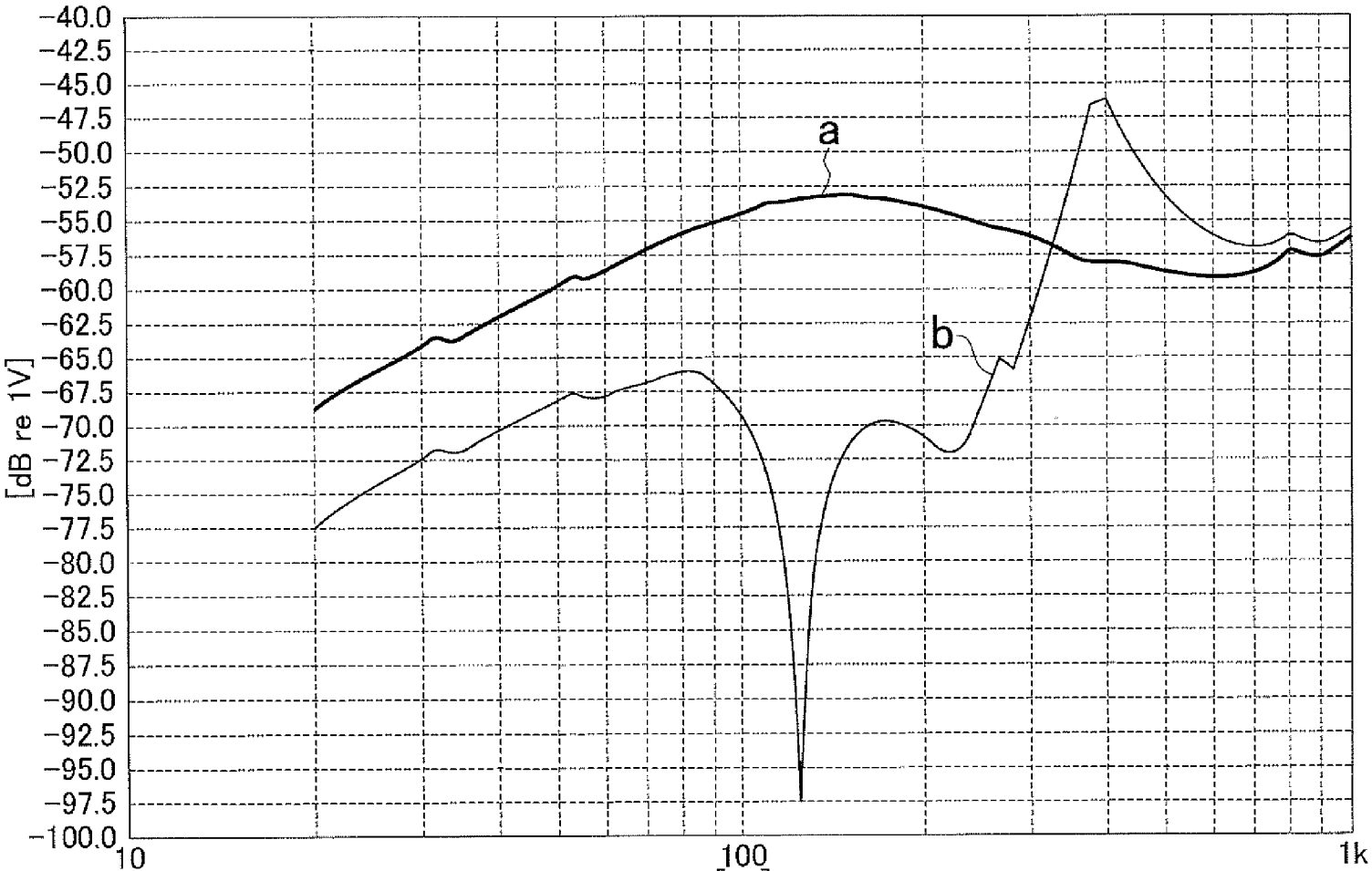
FIG. 9 is a graph showing vibration noise from a microphone unit and a signal after the vibration noise is canceled by a resonance circuit in the embodiment.
Figure 10:
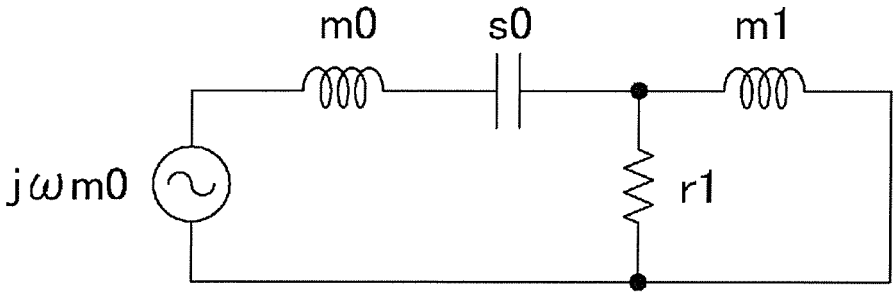
RELATED ART FIG. 10
FIG. 10 is an acoustic equivalent circuit diagram of a typical conventional dynamic microphone.

FIG. 9 shows the cancellation effect of the vibration noise output from the microphone unit using the resonance circuit in the embodiment. In FIG. 9, the curve "a" represents the vibration noise from the microphone unit and the curve "b" represents an output signal from the microphone unit after the vibration noise is cancelled by the resonance circuit. FIG. 9 reveals that the vibration noise represented by the curve "a" is cancelled in its peak region, so that the noise can be effectively reduced as shown by the curve "b". With reference to FIG. 9, the output signal from the microphone unit has a peak at about 400 Hz after the vibration noise is cancelled by the resonance circuit. The peak appears due to mechanical resonance, and can be eliminated by supporting the microphone unit as a whole through the shock mounts 11 and 12 shown in FIG. 1 for vibration proof. The peak, however, does not significantly affect sound quality. For example, in the case of a microphone having a limited volume such as a wireless microphone, a microphone unit may be directly supported by a microphone case without shock mounts.

As described above in the embodiment of the invention, the vibration noise from the microphone unit is actively cancelled using the vibration pickup 5 including the laminated ceramic piezoelectric element 51 having a large capacitance as a component of the resonance circuit. That is, the vibration noise is cancelled by the output signal from the resonance circuit. This achieves effective cancellation of the vibration noise from the microphone unit at a relatively low frequency band. In addition, the resonant frequency, resonance sharpness, and signal level of the cancellation signal can be electrically and continuously adjusted in correspondence to the vibration noise, which facilitates production of a cancellation signal similar to the vibration noise from the microphone unit, achieving a dynamic microphone that can effectively reduce the vibration noise.

The resonant frequency, resonance sharpness, and signal level of the cancellation signal are adjusted while output signals from an objective microphone are observed, the objective microphone being placed in an acceleration-adjustable vibrator that is driven for the observation. The variable capacitor C, the inductor 6, and the variable resistances VR1 and VR2 are adjusted to minimize the output level of the vibration noise. A signal having a certain range of a frequency band or frequency is input to the vibrator, and the vibrator is driven at a frequency band corresponding to the input signal. This adjustment is performed shortly before the final step of a manufacturing process of a microphone, and such adjusted positions are maintained semi-permanently.

While the invention has been described with a case of cancelling the vibration noise in the dynamic microphone, particularly, the unidirectional dynamic microphone, the vibration pickup and the resonance circuit used in the invention may be added to other types of microphones, for example, capacitor microphones.

What is claimed is:

1. A dynamic microphone comprising:

a dynamic microphone unit;

a vibration pickup that detects vibration of the dynamic microphone unit, and outputs a signal for cancelling a vibration noise signal output from the dynamic microphone unit; and a microphone case that supports the dynamic microphone unit and the vibration pickup, wherein the vibration pickup includes a laminated ceramic piezoelectric element that is supported in an integrated manner with a microphone unit case, and detects vibration of the microphone unit case and outputs a signal corresponding to the detected vibration, the laminated ceramic piezoelectric element has a capacitance that defines a resonance circuit in conjunction with an inductance of an inductor connected to the laminated ceramic piezoelectric element, the resonance circuit producing a response signal to acceleration corresponding to that of the vibration noise from the microphone unit, and the resonance circuit is connected to the microphone unit such that the response signal is output in an opposite direction to the vibration noise signal output from the microphone unit.

2. The dynamic microphone according to claim 1, wherein the dynamic microphone unit is a unidirectional dynamic microphone unit.

3. The dynamic microphone according to claim 1, wherein the laminated ceramic piezoelectric element includes a ceramic outputting a signal, the ceramic being fixed to a surface of a disk electrode substrate, and the periphery of the electrode substrate is supported by the microphone unit case.

4. The dynamic microphone according to claim 3, wherein the laminated ceramic piezoelectric element includes ceramics outputting signals, the ceramics being fixed to the respective sides of the electrode substrate.

5. The dynamic microphone according to claim 3, wherein a weight is fixed to the ceramic fixed to the surface of the electrode substrate.

6. The dynamic microphone according to claim 1, wherein a variable capacitor is connected in series to the resonance circuit, and the resonant frequency of the resonance circuit can be varied by changing the capacitance of the variable capacitor.

7. The dynamic microphone according to claim 1, wherein the inductor is a variable inductor, and a resonance frequency of the resonance circuit can be varied by changing the inductance of the variable inductor.

8. The dynamic microphone according to claim 1, wherein a variable resistance is connected in series to the resonance circuit, and resonance sharpness of the resonance circuit can be varied by changing the resistance value of the variable resistance.

9. The dynamic microphone according to claim 1, wherein a variable resistance is connected parallel to the resonance circuit, and a signal level of the resonance circuit can be varied by changing a resistance value of the variable resistance.

10. The dynamic microphone according to claim 1, wherein the microphone unit case is supported by shock mounts in the microphone case.

* * * * *